United States Patent [19]

Date et al.

[11] 4,069,667

[45] Jan. 24, 1978

[54] ENGINE EXHAUST PORT LINER

[75] Inventors: Tasuku Date, Tokyo; Shuichi Yamazaki; Shinichi Shimada, both of Kamifukuoka, all of Japan

[73] Assignee: Honda Giken Kogyo Kabushiki Kaisha, Tokyo, Japan

[21] Appl. No.: 677,666

[22] Filed: Apr. 16, 1976

[30] Foreign Application Priority Data

Apr. 22, 1975 Japan ..... 50-54075
Apr. 22, 1975 Japan ..... 50-54076

[51] Int. Cl.[2] ..... F01N 7/14; F01N 7/18

[52] U.S. Cl. ..... 60/282; 123/191 A; 123/193 H

[58] Field of Search ..... 60/282, 272; 123/191 A, 123/193 H

[56] References Cited

FOREIGN PATENT DOCUMENTS

| | | | |
|---|---|---|---|
| 2,323,793 | 11/1974 | Germany | 60/282 |
| 302,487 | 0000 | U.S.S.R. | 60/282 |

*Primary Examiner*—Douglas Hart
*Attorney, Agent, or Firm*—Lyon & Lyon

[57] ABSTRACT

An exhaust port liner for an internal combustion engine has an entrance opening at one side into which exhaust gases are directed by means of a cylindrical sleeve fixed relative to the exhaust valve seat. A portion of the poppet type exhaust valve extends through the sleeve and into the entrance opening. The liner is inserted into the exhaust port from the discharge end of the exhaust port. The liner is secured to the valve stem guide and is also supported near its discharge opening. The sleeve may be fixed to an insulating ring abutting the valve seat, or the sleeve may be threaded directly to the valve seat.

2 Claims, 3 Drawing Figures

ENGINE EXHAUST PORT LINER

This invention relates to internal combustion engines and is particularly directed to an exhaust port liner construction. It is desirable to provide an exhaust port liner which extends continuously from the exhaust valve seat to the discharge end of the exhaust port. But it is difficult to insert the exhaust port liner into the exhaust port from the discharge end of the exhaust port. One of the objects of this invention is to solve and improve the above mentioned difficulty. In this invention a stationary sleeve extending downstream from the exhaust valve seat is employed to direct the exhaust gases into an entrance opening provided at one side of the liner. The liner and sleeve are made of thin wall heat resistant material. The purpose of this construction is to minimize cooling of the exhaust gases after they pass the exhaust valve and before they pass into an exhaust system having one or more exhaust reaction chambers. Maintaining a high temperature of the exhaust gases for a relatively long period of time minimizes the quantities of unburned hydrocarbons and carbon monoxide discharged into the atmosphere. The exhaust port liner and sleeve are spaced from the water-cooled cylinder head, and accordingly these parts remain at a relatively high temperature during operation of the engine.

Other and more detailed objects and advantages will appear hereinafter.

Figure 1:
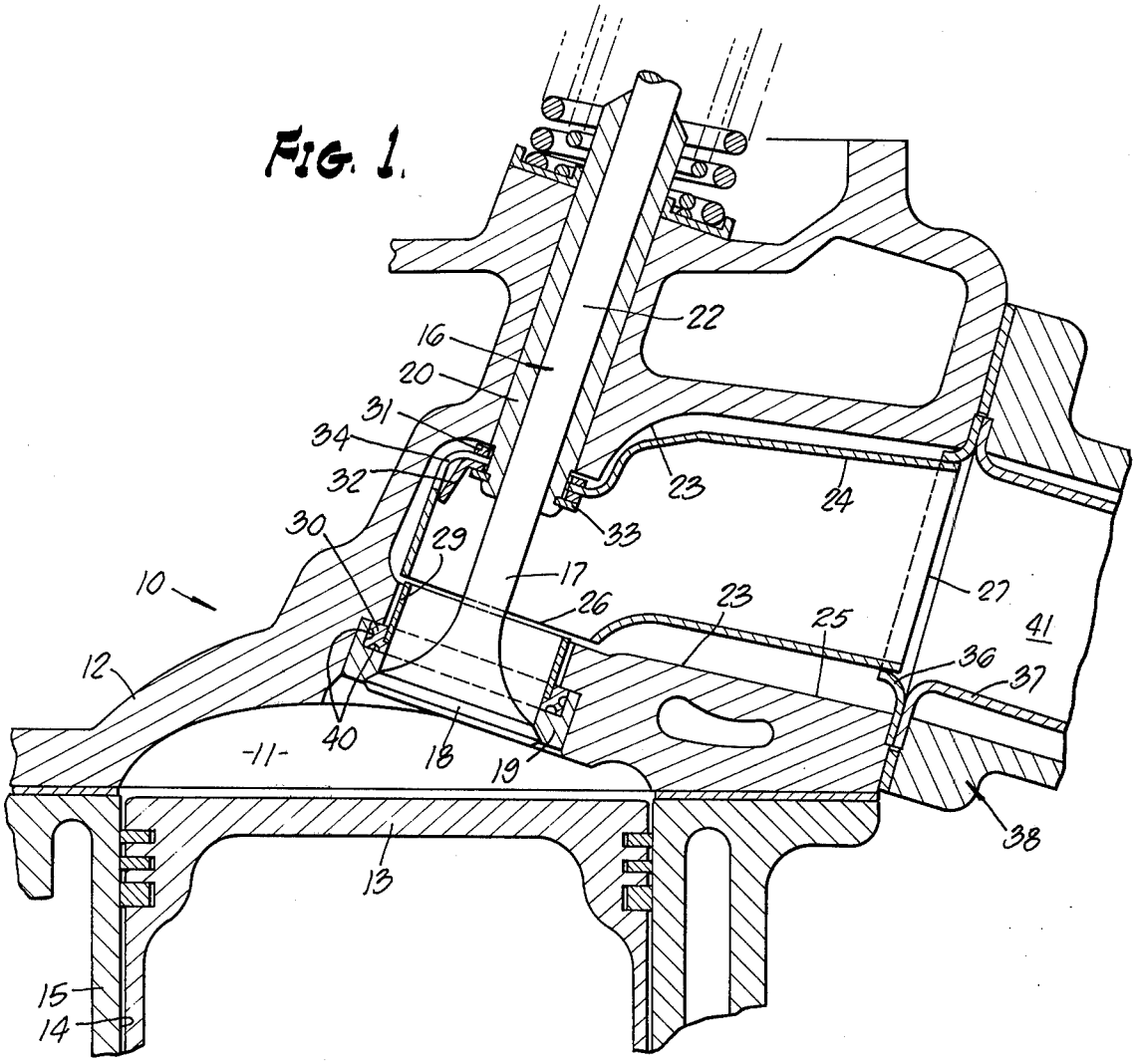
FIG. 1 is a sectional elevation partly broken away, showning a preferred embodiment of this invention.
Figure 2:
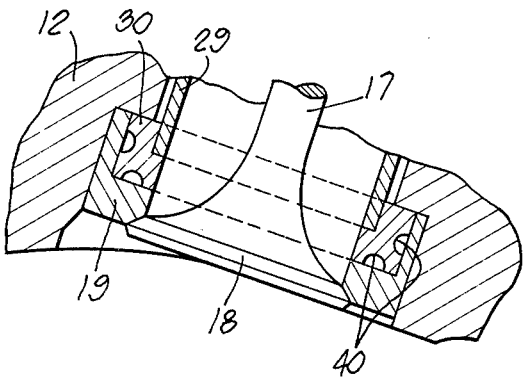
FIG. 2 shows a portion of FIG. 1 on an enlarged scale.

Referring to the drawings, the internal combustion engine generally designated 10 is provided with a combustion chamber 11 defined between the cylinder head 12 and the piston 13 which reciprocates in the cylinder 14 formed in the engine block 15. An exhaust valve assembly generally designated 16 includes a poppet type valve 17 having a head 18 adapted to seal against a stationary valve seat 19. A stationary guide 20 mounted in the cylinder head 12 guides the stem 22 of the valve 17 as it is caused to reciprocate during operation of the engine.

An exhaust port 23 extends downstream from the valve seat 19. In accordance with this invention, an exhaust port liner 24 formed of thin wall heat resistant material is inserted into the exhaust port 23 from a discharge end 25 of the exhaust port 23 but is spaced from the walls thereof. The liner 24 has an entrance opening 26 at one side and has a central discharge opening 27. A cylindrical sleeve 29 is fixed relative to the valve seat 19 and is positioned to direct exhaust gases into the entrance opening 26. The sleeve 29 is formed of thin wall heat resistant material and is secured to the ring 30 formed of heat insulating material. The ring 30 is fixed to the valve seat 19. Annular grooves 40 are provided between the ring 30 and the valve seat 19 so as to improve the heat insulating efficiency of the ring 30.

Means are provided for supporting the liner 24 on the valve stem guide 20, and as shown in the drawings this means includes a spacer washer 31, a retainer clip 32 and a split retainer ring 33. A slot 34 in the liner 24 is provided for purposes of assembly, and the clip 32 covers the slot 34. The liner 24 is also supported near its discharge opening 27. A support piece 36 has a central opening which slidably receives the downstream end of the liner 24, and this support piece 36 is clamped against the flanged open end of the exhaust pipe 37 which extends into the exhaust system. This construction is the subject of the copending application of Yamazaki et al Ser. No. 677,667 filed Apr. 16, 1976. The exhaust pipe 37 and a housing 38 surrounding and enclosing it form an exhaust passage 41.

Figure 3:
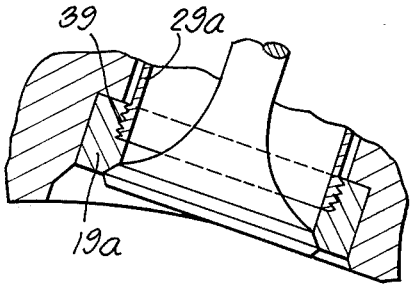
FIG. 3 is a fragmentary sectional view showing a modification.

In the modified form of the invention shown in FIG. 3, the sleeve **29*a* formed of heat insulating material is fixed to the valve seat 19*a* by means of threads 39**.

Having fully described our invention, it is to be understood that we are not to be limited to the details herein set forth, but that our invention is of the full scope of the appended claims.

We claim:

1. In an internal combustion engine having an exhaust valve and valve seat operatively interposed between a combustion chamber and walls forming an exhaust port, the improvement comprising, in combination: an elongated exhaust port liner positioned within the exhaust port and spaced from the walls thereof, said liner having an entrance opening at one side through which the valve extends, said liner being shaped for insertion into operative position through the discharge end of the exhaust port, a stationary cylindrical sleeve extending downstream from said valve seat and positioned to direct exhaust gases into said entrance opening, said sleeve being fixed to a heat insulating ring abutting said valve seat, said liner having a discharge opening, and means supporting said liner near its discharge opening.

2. In an internal combustion engine having an exhaust valve and valve seat operatively interposed between a combustion chamber and walls forming an exhaust port, the improvement comprising, in combination: an elongated exhaust port liner positioned within the exhaust port and spaced from the walls thereof, said liner having an entrance opening at one side through which the valve extends, said liner being shaped for insertion into operative position through the discharge end of the exhaust port, a stationary cylindrical sleeve extending downstream from said valve seat and positioned to direct exhaust gases into said entrance opening, said sleeve being threaded to said valve seat, said liner having a discharge opening, and means supporting said liner near its discharge opening.

* * * * *